United States Patent [19]

Harney

[11] Patent Number: 4,881,279

[45] Date of Patent: Nov. 21, 1989

[54] DUAL FLUSH MECHANISM

[76] Inventor: Donald E. Harney, 1113 Highway 99 North, Eugene, Oreg. 97402

[21] Appl. No.: 325,886

[22] Filed: Mar. 20, 1989

[51] Int. Cl.[4] ..... E03D 1/14; E03D 3/12

[52] U.S. Cl. ..... 4/324; 4/325; 4/249; 4/378; 4/405; 4/415

[58] Field of Search ..... 4/324, 325–327, 4/415, 249, 405, 378

[56] References Cited

U.S. PATENT DOCUMENTS

| | | | |
|---|---|---|---|
| 2,532,977 | 12/1950 | White | 4/325 |
| 2,922,168 | 1/1960 | Crandall | 4/384 |
| 3,787,902 | 1/1974 | McCombs | 4/325 |
| 4,175,296 | 11/1979 | Goldman | 4/326 |
| 4,406,024 | 9/1983 | Chiu et al. | 4/324 |
| 4,750,220 | 6/1988 | Baumann | 4/324 |

*Primary Examiner*—Henry K. Artis
*Attorney, Agent, or Firm*—John F. Ingman

[57] ABSTRACT

A dual flush mechanism which allows the user to select either a full or partial flush, while using a single flush valve. A full flush is obtained by a first handle which lifts a flush valve actuating arm to unseat the flush valve in a conventional manner. For a partial flush, a second handle rotates and lifts a partial-flush control arm which extends beneath the flush valve actuating arm. Upward movement of the partial-flush control arm is limited. Release of the second handle permits the control arm to rotate downwards until stopped by the engagement of a portion of the control arm with a transversely extending lever extension, thereby keeping the flush valve in an unseated position. As the tank water lever lowers, a partial-flush float also lowers, pulling down the end of a lever which pivots so as to linearly retract the lever extension from engagement with the partial-flush control arm. This permits the control arm to drop, reseating the flush valve. With the refilling of the tank, the partial-flush float rises, forcing the lever, by means of a rigid connecting member, to rotate so as to cause the pivotally attached lever extension to move into pressurized contact against the control arm in preparation for the next partial-flush cycle.

5 Claims, 3 Drawing Sheets

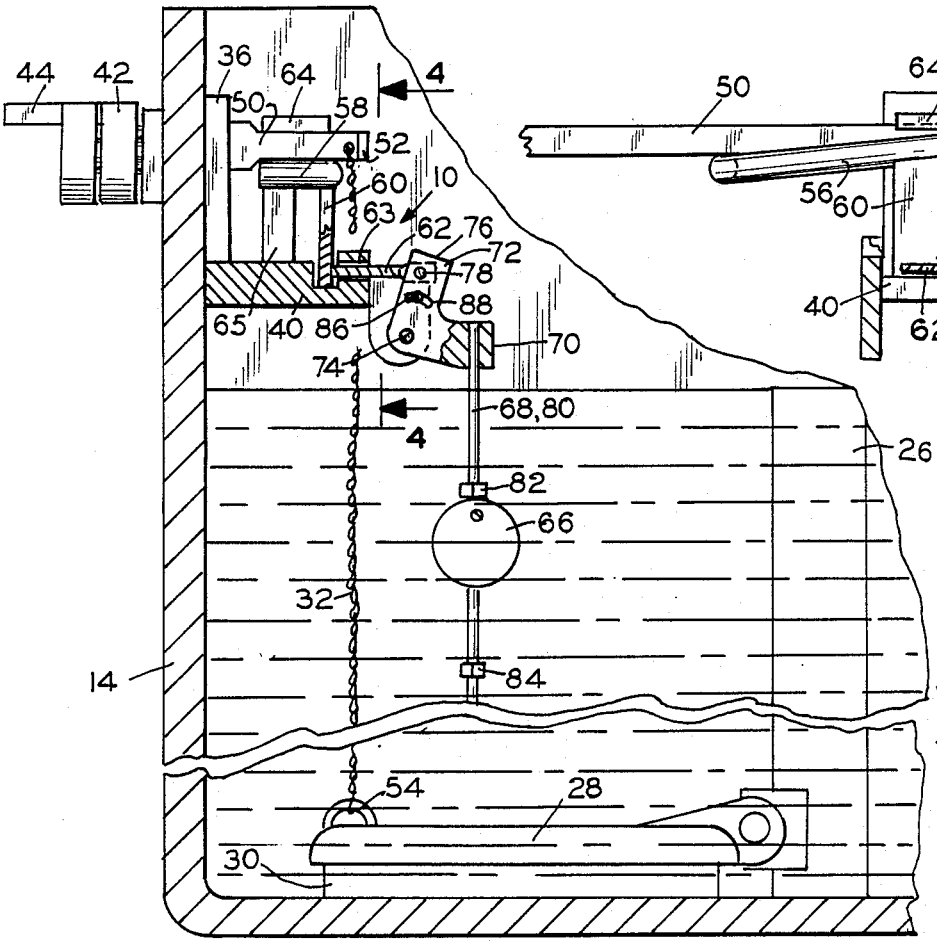
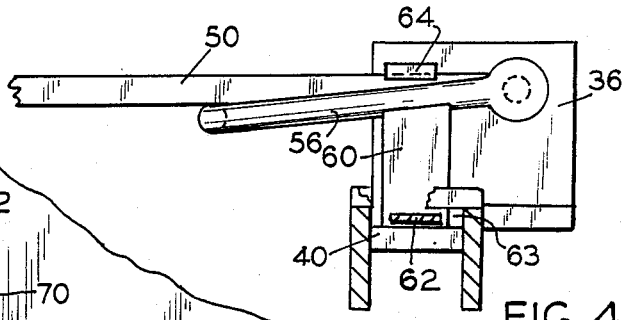
FIG. 4
FIG. 3
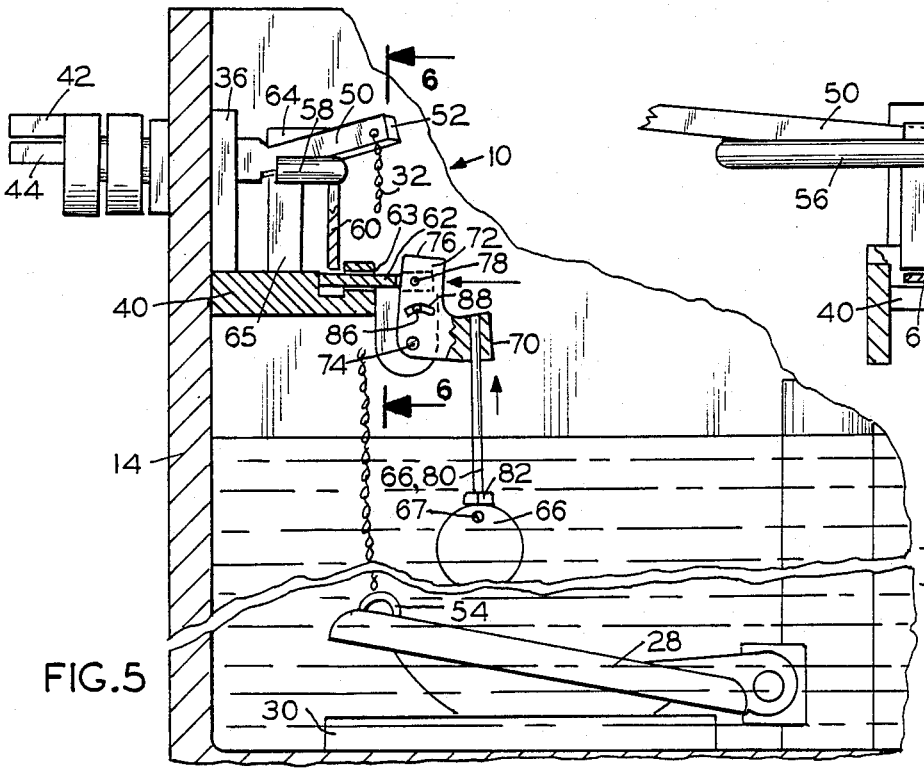
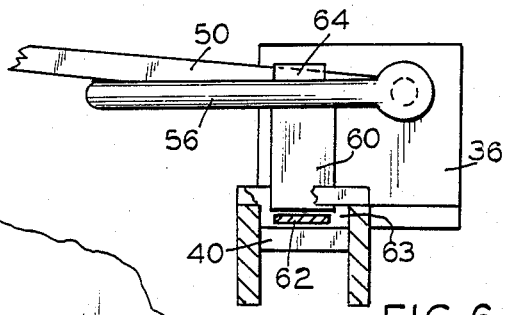
FIG. 6
FIG. 5

DUAL FLUSH MECHANISM

BACKGROUND OF THE INVENTION

1. Field of the Invention

The present invention generally relates to dual flush mechanisms for toilets, and, more particularly, a dual flush mechanism which utilizes only a single flush valve.

2. Description of the Prior Art

Various dual flush toilet mechanisms have been developed over the years for the purpose of providing the user with a choice of a "short" or partial flush to carry away liquid waste and a "long" or full flush for solid waste. The benefit of a dual flush arrangement is the potential savings of large quantities of water in times where water is becoming an increasingly scarce and valuable commodity.

Previous dual flush mechanism designs have characteristically used two separate flush valves, the full flush valve being located at a low level within the tank to receive a full volume of water, and the partial flush valve being located at mid-level within the tank to receive only a portion of the tank volume. In order to replace conventional flushing mechanisms with such dual flush mechanisms, it was necessary to replace both the pre-existing conventional single flush valve, and its associated plumbing, with a two flush valve configuration, a prospect which was too complicated or costly for the ordinary user.

The inventor, in response, developed a dual flush mechanism which operates with only a single flush valve, and which is simple to install and maintain, for which U.S. Pat. No. 4,764,995 was issued. The construction of this dual flush mechanism, however, was somewhat complex, particularly in the use of rack and pinion gearing to control the partial flush capability. A need exists to further simplify the dual flush mechanism of that patent, thereby decreasing its cost and increasing its reliability and availability.

SUMMARY OF THE INVENTION

The present invention provides a dual flush mechanism which is designed to satisfy the aforementioned need. The invention involves a simplified dual flush mechanism which provides either a full or partial flush capability utilizing only a single flush valve.

Accordingly, in the preferred embodiment, the invention comprises a dual flush mechanism which allows the user to select, by handle control means, either a full or partial flush. A full flush is obtained by a first handle control means which lifts a flush valve actuating arm. The flush valve actuating arm is attached, by a flexible connecting member, to the flush valve, wherein lifting of the arm unseats the flush valve and permits a full flush in a conventional manner. To achieve a partial flush, a second handle control means rotates and lifts a partial-flush control arm which extends beneath, and contacts, during the partial flush cycle, the flush valve actuating arm. Upward movement of the partial-flush control arm is limited, thereby restricting the corresponding lift of the flush valve actuating arm, and of the flush valve. Release of the second handle control means permits the partial-flush control arm to rotate downwards until stopped by the engagement of the partial-flush control plate, a portion of the partial-flush control arm, with a transversely extending lever extension, which has projected outwardly beneath the partial-flush control plate. This stopping of the partial-flush control arm also limits the downward movement of the flush valve actuating lever and thereby keeps the flush valve in an unseated position with associated water flow from the tank. As the water level in the tank lowers, a partial-flush float also lowers, pulling down a rigidly connected end of a partial-flush control lever which pivots about a mid-lever pivot axis. This pivoting of the partial-flush control lever linearly retracts the lever extension, which is pivotally attached to the partial flush control lever, from engagement with the partial-flush control plate This disengagement permits the partial-flush control arm to drop, thus allowing the flush valve actuating arm to lower and the flush valve to reseat, so as to terminate the flow of water from the tank. With the refilling of the tank in the conventional manner, the partial-flush float also rises, lifting an end of the partial-flush control lever, through their rigid connection, thereby re-rotating the lever about its pivot axis so as to cause the lever extension to move outwards until it contacts, under pressure, the side of the partial-flush control plate in preparation for the next partial-flush cycle.

BRIEF DESCRIPTION OF THE DRAWINGS

FIG. 3 illustrates a partial sectional view of the dual flush mechanism in a pre-flush configuration.

FIG. 4 illustrates a partial sectional view of the dual flush mechanism as seen at line 4—4 of FIG. 3.

FIG. 5 illustrates a partial sectional view of the dual flush mechanism, during the initial part of the partial flush cycle.

FIG. 6 illustrates a partial sectional view of the dual flush mechanism as seen at line 6—6 of FIG. 5.

DESCRIPTION OF THE PREFERRED EMBODIMENT

Figure 1:
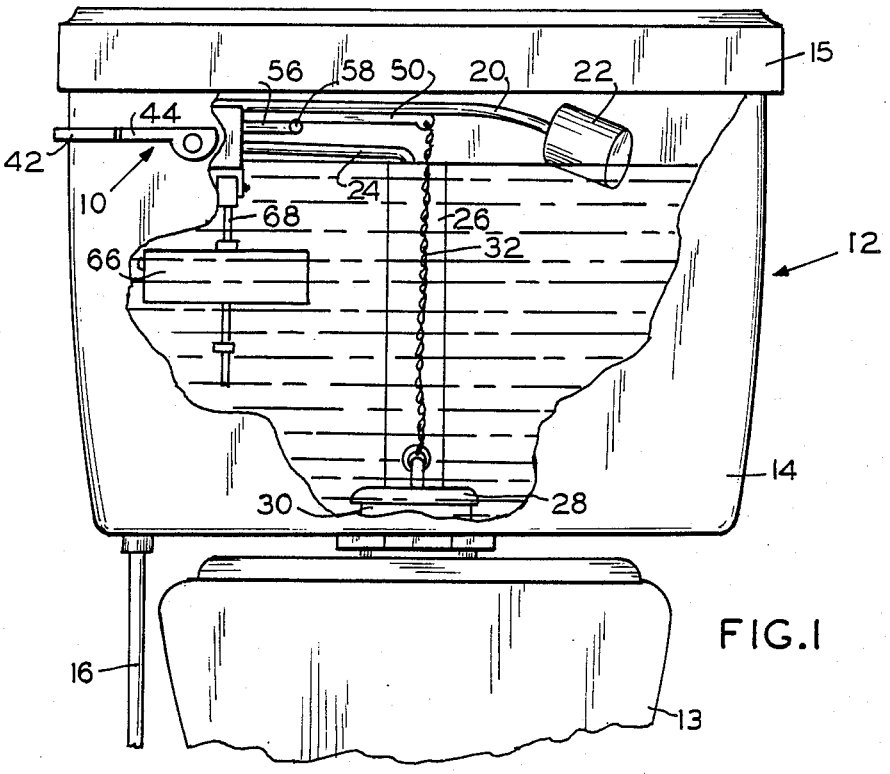
FIG. 1 illustrates a front view of a toilet with water tank having the dual flush mechanism installed therein.
Figure 2:
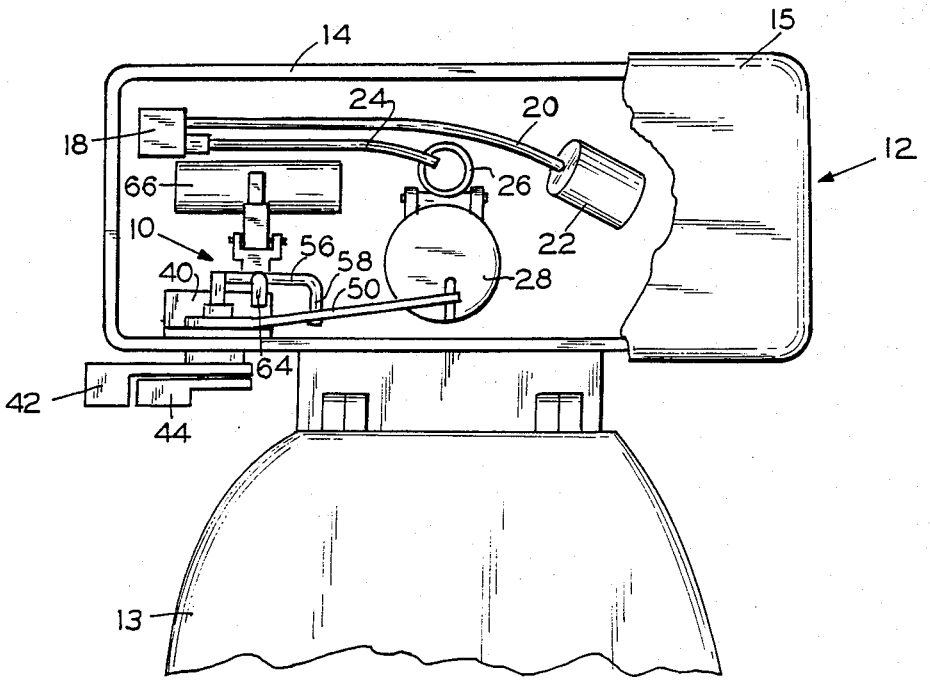
FIG. 2 illustrates a top view of the toilet with water tank having the dual flush mechanism installed therein.

Turning now to the drawings, and particularly to FIG. 1 and FIG. 2, there is shown the preferred embodiment of the dual flush mechanism 10 as installed in a common toilet 12 with bowl 13 and water tank 14 with tank top 15. Conventional components within the tank 14 include a water inlet pipe 16 terminating at an inlet valve 18 operated by an arm 20 and float 22 combination. Post-flush cleaning of bowl 13 is accomplished by a tube 24 carrying water from the inlet valve 18 and into the overflow standpipe 26. A flush valve 28 of the flapper valve type, such as Model 57 manufactured by Lavelle Industries, Chicago, Illinois, rests upon the flush valve seat 30 with a connection, normally flexible, and illustrated as a chain 32, which extends upwardly to connect with the dual flush mechanism 10. The above components, other than the dual flush mechanism 10, are conventional within the tank 14 of a toilet 12 and are not inventive subject matter.

What is unique is the simplified dual flush mechanism 10 which is installed as an entity to permit the capability of either a partial flush for liquid waste or a full flush for solid waste matter.

Figure 9:
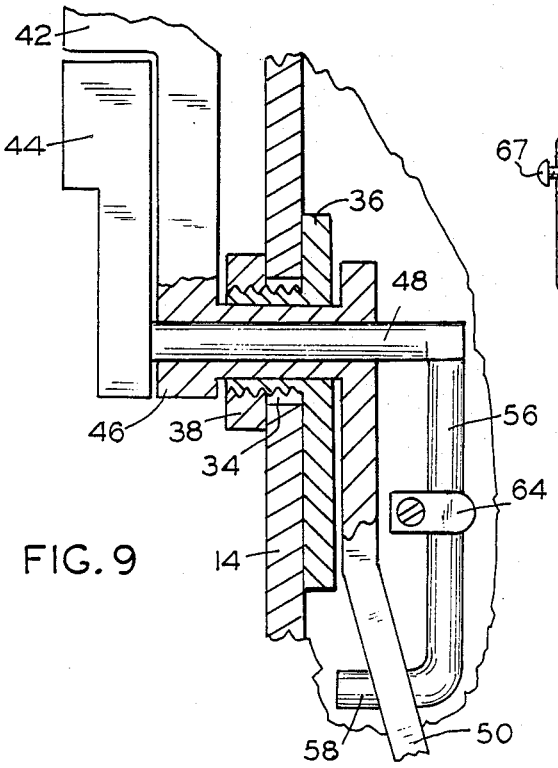
FIG. 9 illustrates a partial sectional view as seen a line 9—9 of FIG. 7.

The dual flush mechanism 10 is attached through and supported at the conventional hole 34, formed in the water tank 14 for the normal single flush handle, by means of a handles support casing 36 and nut 38. A support base 40, fixedly attached to the handles support casing 36 supports the remainder of the dual flush mechanism 10. In the preferred embodiment, two separate handles 42 and 44 are utilized, wherein they are connected to, and operate, the mechanism by concentric shafts 46 and 48 respectively which extend through the handles support casing 36 (as best seen at FIG. 9). As will be described subsequently, handle 42 and outer shaft 46 correspond to the full flush, and handle 44 with inner shaft 48 operates the partial flush.

Extending from outer shaft 46 is a flush valve actuating arm 50, which arm 50 extends roughly horizontally from outer shaft 46 to a position above the flapper-style flush valve 28 there it is connected at its outer end 52, as by flexible chain 32, to the lifting connection 54 of the flush valve 28. The handle 42, outer shaft 46, flush valve actuating arm 50, chain 32 and flush valve 28 act in combination to provide a full flush similar to the full flush of the conventional toilet, wherein rotation of the handle 42 and its shaft 46 pivots the outer end 52 of the flush valve actuating arm 50 upwards, thereby, through chain 32, lifting the flush valve 28 to permit the egress of water through the flush valve seat 30. Upon the lowering of the water level in the tank 14 so that the flush valve 28 is no longer supported fully open by the flow of water, the flush valve 28 closes upon the valve seat 30 and the egress of water from the tank 14 in the full flush mode is terminated.

Handle 44 is attached to the inner shaft 48 which extends slightly further into the tank 14 than outer shaft 46. At the end of inner shaft 48, a partial-flush control arm 56 is fixedly attached, said partial-flush control arm 56 extending, essentially parallel and beneath the flush valve actuation arm 50. In the preferred embodiment, the partial-flush control arm 56 has at its outer end a ninety degree bend or hook 58 so that the partial-flush control arm 56 extends transversely beneath the flush valve actuating arm 50, thereby assuring contact of the flush valve actuating arm 50 from beneath by the partial-flush control arm 56. FIG. 3 and FIG. 4 illustrate the dual flush mechanism 10 before flushing.

A partial flush is initiated by downward pressure on handle 44 so as to rotate upwards the hook end 58 of the partial-flush control arm 56. The partial-flush control arm 56, being beneath and in contact with the flush valve actuating arm 50, thereby causes the flush valve actuating arm 50 to raise at its outer end 52, so as to, by means of chain 32, lift the flush valve 28 from the flush valve seat 30. However, upward movement of the partial-flush control arm 56 is restricted by limit member 64, which extends horizontally from a vertical post 65 on the support base 40, so as to physically block further upward movement of the partial-flush control arm 56 (The flush valve actuating arm 50 does not engage limit member 64, as may be best seen in FIG. 2.) Therefore, the flush valve actuating arm 50 can only be raised a limited distance by the partial flush control arm 56, and the flush valve 28 is not lifted from the flush valve seat 30 to the extent that it is in the full flush mode of operation. In the partial flush mode, the flush valve 28 is held open by the lift of chain 32, rather than by the egress of water as in a full flush. FIG. 5 and FIG. 6 illustrate the dual flush mechanism immediately after handle rotation for a partial flush.

Attached to, or formed with, the partial-flush control arm 56, is a partial-flush control plate 60, which extends vertically downward from the partial-flush control arm 56 between its attachment to the shaft 48 and its outer end 58. In the pre-flush configuration, as illustrated in FIG. 3 and FIG. 4, a lever extension 62, which extends through a slot 63, presses, as described subsequently, against the side of the partial-flush control plate 60. When the partial-flush control arm 56 is raised, the partial-flush control plate 60 is lifted clear of the lever extension 62. The lever extension 62 will then extend further through the slot 63 to a position beneath the raised partial-flush control plate 60.

When the handle 44 is released, the partial-flush control arm 56 rotates back downwards so that the partial-flush control plate 60 rests atop the lever extension 62, as seen in FIG. 5 and FIG. 6. The partial-flush control arm 56 thus is held at an elevated position, and consequently the flush valve actuating arm 50, through the chain 32, holds the flush valve 28 in a partially open position to permit continuing egress of water during this portion of the partial-flush cycle.

As the water level decreases, a partial-flush float 66 lowers within the tank 14. The partial-flush float 66 is attached, by an rigid connection 68, such as an elongated threaded rod 80, to an end 70 of a partial flush control lever 72. The partial-flush control lever 72 pivots about pivot axis 74. The second end 76 of the partial-flush control lever 72 has connected thereto the lever extension 62 which is pivotally attached at 78 so that the rotation of the partial-flush control lever 72 about pivot axis 74 will cause substantially linear movement of the lever extension 62.

Figure 7:
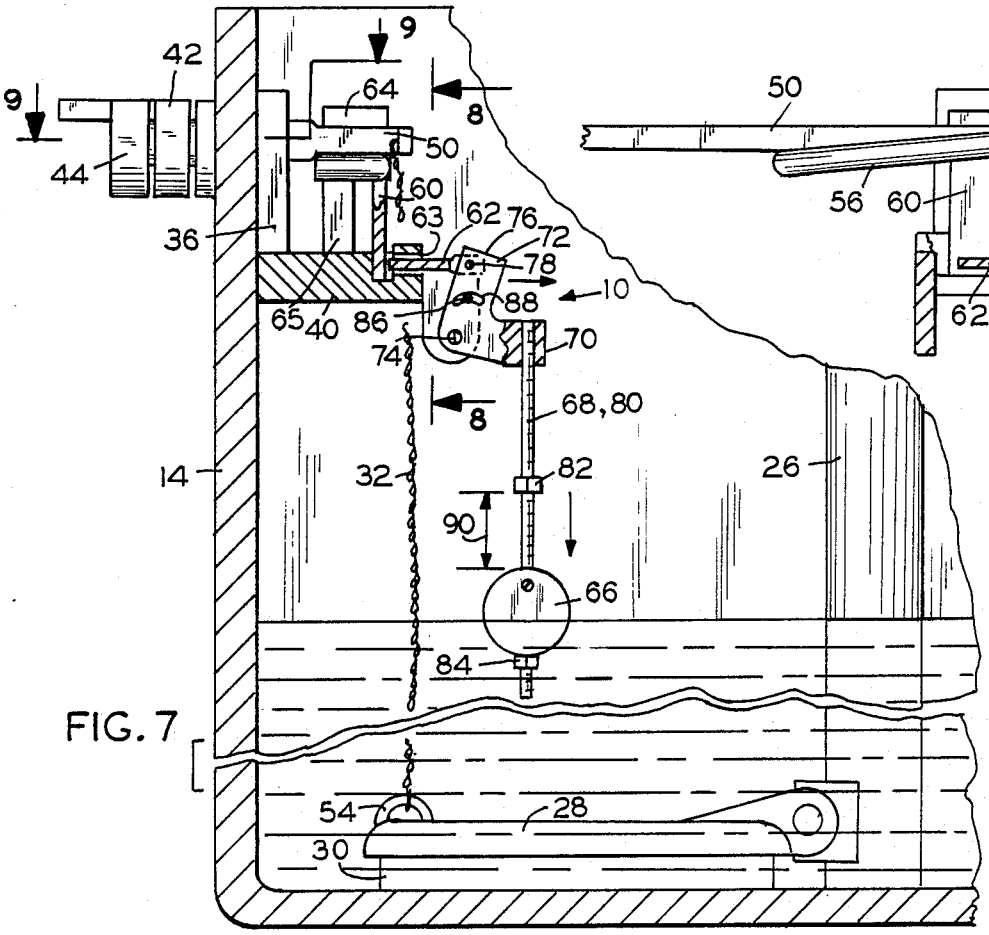
FIG 7 illustrates a partial sectional view of the dual flush mechanism with a partially emptied tank during the partial flush cycle.
Figure 8:
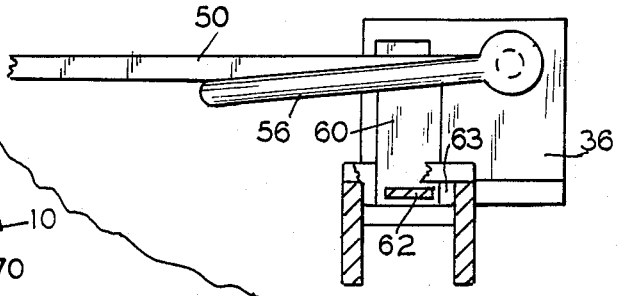
FIG 8 illustrates a partial sectional view of the dual flush mechanism as seen at line 8—8 of FIG. 7.

As the partial-flush float 66 is lowered by the egress of water, the end 70 of tee partial flush control lever 72 is pulled downwards, thereby rotating the partial-flush control lever 72 about pivot axis 74, which, in turn displaces the lever extension 62 from beneath the partial-flush control plate 60, as seen in FIG. 7. The partial-flush control arm 56 and its hook end 58 can then drop downwards, which also permits the end 52 of the flush valve actuating arm 50 to fall, thereby allowing the flush valve 28 to reseat, stopping the flow of water from the tank 14 so as to result in a partial flush. The extent of movement of the partial-flush control lever 72 and lever extension 62 may be limited by a pin 86 engaging a recess 88 in the partial-flush control lever 72.

As the tank 14 refills conventionally, the partial-flush float 66 rises in the tank 14 so as to force, by means of rigid connection 68, the partial-flush control lever 72 to rotate about the pivot axis 74 in the opposite direction from when the float 66 was lowering. Such pivoting movement causes the lever extension 62 to linearly move towards and into pressurized contact against the side of the partial flush control plate 60, as seen in FIGS. 3 and 4 in the pre-flush condition. When the partial-flush control arm 56, by rotation of handle 44 to initiate a partial flush, is lifted to clear the lever extension 62, the lever extension 62, due to continuing upward pressure on the end 70 of the partial-flush control lever 72 by the rigidly connected partial-flush float 66, extends further through the slot 63 to a position beneath the partial-flush control plate 60. The rapidity of this movement of the lever extension 62 will depend on the amount of flotation of the partial-flush float 66. The weight and The flotation of the partial-flush float 66 may be adjusted by varying the amount of water in a hollow float 66, as may be accomplished, for example, by the removal of a screw 67 located in the float 66.

Figure 10:
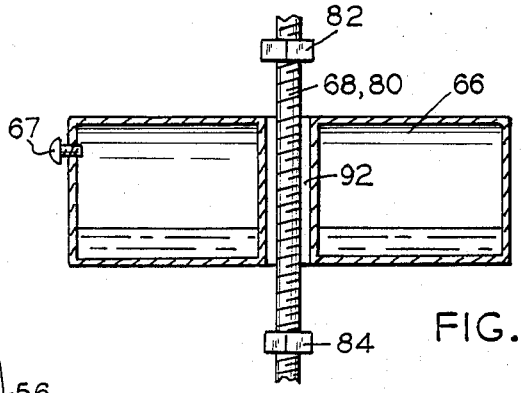
FIG. 10 illustrates a sectional view of the hollow partial flush float mounted on a threaded rod.
Figure 11:
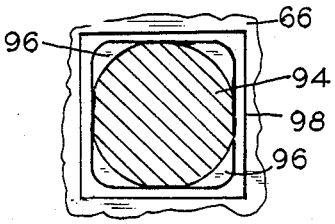
FIG. 11 illustrates a cross section of a non-circular configuration of the threaded rod of FIG. 10.

The position of the float 66 along the rigid connector 68 may be readily adjusted. Where the rigid connector 68 is a threaded rod 80, a pair of knurled nuts 82 and 84, which are adjustable up and down the threaded rod 80, may be located above and below the float 66 so as to adjustably fix its position in the positioning of nuts 82 and 84, a free space 90, as seen in FIG. 7, may be provided along the threaded rod 80, thereby creating a time delay, as the float 66 moves downward, before downward force is applied to the end 70 of the partial-flush control lever 72 to terminate the partial flush. The adjustment of the free space 90 permits the control of the amount of water released in the partial flush. The float 66 preferably is configured to concentrically fit around the rigid connector 68, a threaded rod 80 as seen in FIG. 10, where a circumferential inner wall 92 is formed to prevent leakage of water into the float 66 which would affect its flotation. Rotation of the float 66 about the rigid connector 68 may be precluded by a rigid connector 94 with a non-circular cross section with threaded corners 96, as seen at FIG. 11 with an inner wall 98 of the float 66 conforming to and tightly fitting about that shape.

It is thought that the simplified dual flush mechanism of the present invention and its many attendant advantages will be understood from the foregoing description and that it will be apparent that various changes may be made in form, construction and arrangement of the parts thereof without departing from the spirit and scope of the invention or sacrificing all of its material advantages, the forms hereinbefore stated being merely exemplary embodiments thereof.

I claim:

1. A dual flush mechanism, to provide a full-flush and a partial-flush capability for toilets with a tank, in combination with a single flush valve, which dual flush mechanism comprises:

a. a flush valve actuating arm, having a first end and a second end, attached near or at its second end to the flush valve by means of a flexible connecting member;

b. a first handle control means, to which the first end of the flush valve actuating arm is attached;

c. wherein the combination of first handle control means, flush valve actuating arm, flexible connecting member, and flush valve comprise the full flush capability;

d. a partial-flush control arm, having a first end and a second end, the partial-flush control arm being constructed to be capable of engaging and lifting the flush valve actuating arm;

e. a second handle control means, to which the first end of the partial flush control arm is attached;

f means for limiting the movement of the partial-flush control arm due to operation of the second handle control means, thereby also limiting the resulting upwards rotational movement of the second end of the flush valve actuating arm due to the movement of the partial-flush control arm;

g. a partial-flush control plate, forming a portion of said partial-flush control arm;

h. a partial-flush control lever, having a first end and a second end, pivotally supported between said first and second ends at a pivot axis;

i. a partial-flush float, attached by a rigid connecting member to said first end of said partial-flush control lever; and j. a lever extension attached to said second end of said partial-flush control lever;

k. wherein movement of the second handle control means will pivot the partial-flush control arm, to the extent permitted by the movement limiting means, thereby lifting the second end of the flush valve actuating arm a limited distance, and, through the flexible connecting member, lifting the flush valve a limited distance to permit egress of water from the tank; subsequent release of the second handle control means permitting the partial-flush control arm to rotate downwards until the lower edge of the control Plate rests against the transversely extending lever extension, thereby also limiting the downward movement of the flush valve actuating lever and keeping the flush valve in a partially open position with associated continuing water egress; said water egress lowering the position of the partial-flush float thereby pulling the first end of the partial-flush control lever downwards and rotating the partial-flush control lever about its pivot axis thereby causing the attached lever extension to retract out from beneath the partial-flush control plate, said retraction freeing restraint on the partial-flush control arm, allowing further downward movement of the partial-flush control arm, with a corresponding downward movement of the flush valve actuating arm and the reseating of the flush valve so as to terminate the egress of water from the tank; with refilling water raising the water level of the tank, the partial-flush float correspondingly rising, the first end of the partial-flush control lever being lifted, through the rigid connecting member attached to the partial-flush float, so as to move the lever about its pivot axis, causing the lever extension to move until in pressured contact against the side of the partial-flush control plate of the partial flush control arm, thereby terminating the partial flush cycle by the dual flush mechanism.

2. The dual flush mechanism, as recited in claim 1, wherein the attachment of the lever extension to the partial-flush control lever is pivotable, so as to provide substantially linear movement for engagement and disengagement with sald partial-flush control plate.

3. The dual flush mechanism, as recited in claim 1, wherein the attachment of the partial-flush float to the first end of the partial-flush control lever by said rigid connecting member includes, additionally, means for controlling the partial flush by spaced, upper and lower positioning limits for the partial-flush float which are adjustable along the rigid connecting member, with the partial-flush float capable of free movement between such limits.

4. A dual flush mechanism, to provide a full-flush and a partial-flush capability for toilets with a tank, in combination with a single flush valve, which dual flush mechanism comprises:

a. a flush valve actuating arm, having a first end and a second end, attached near or at its second end to the flush valve by means of a flexible connecting member;

b. a first handle control means, to which the first end of the flush valve actuating arm is attached;

c. wherein the combination of first handle control means, flush valve actuating arm, flexible connecting member, and flush valve comprise the full flush capability;

d. a partial-flush control arm, having a first end and a second end, the partial-flush control arm extending essentially parallel to, and beneath, the flush valve actuating arm;

e. a second handle control means, to which the first end of the partial flush control arm is attached;

f. means for limiting upward rotational movement of the second end of the partial-flush control arm due to operation of the second handle control means, thereby also limiting resulting upwards rotational movement of the second end of the flush valve actuating arm due to the upward movement of the second end of the partial-flush control arm located beneath the flush valve actuating arm;

g. a partial-flush control plate, forming a portion of said partial-flush control arm;

h. a partial-flush control lever, having a first end and a second end, pivotally supported between said first and second ends at a pivot axis;

i. a partial-flush float, attached by a rigid connecting member to said first end of said partial-flush control lever;

j. said rigid connecting member having spaced, upper and lower position limits above and below the partial-flush float, which restrict the movement of the partial-flush float along the rigid connecting member between said limits, the partial-flush float being capable of free movement between said upper and lower position limits, said upper and lower position limits being individually adjustable along the rigid connecting member; and k. a lever extension pivotally attached to said second end of said partial-flush control lever so as to provide substantially linear movement for engagement and disengagement with said partial-flush control plate;

l. wherein movement of the second handle control means will pivot the second end of the partial-flush control arm upwards, to the extent permitted by the upward movement limiting means, thereby lifting the second end of the flush valve actuating arm a limited distance, and, through the flexible connecting member, lifting the flush valve a limited distance to permit egress of water from the tank; subsequent release of the second handle control means permitting the partial-flush control arm to rotate downwards until the lower edge of the control plate rests against the transversely extending lever extension, thereby also limiting the downward movement of the flush valve actuating lever and keeping the flush valve in a partially open position with associated continuing water egress; said water egress lowering the position of the partial-flush float, thereby pulling the first end of the partial-flush control lever downwards and rotating the partial-flush control lever about its pivot axis thereby causing the pivotally attached lever extension to retract out from beneath the partial-flush control plate, said retraction freeing restraint on the partial-flush control arm, allowing further downward movement of the partial-flush control arm, with a corresponding downward movement of the flush valve actuating arm and the reseating of the flush valve to as to terminate the egress of water from the tank; with refilling water raising the water level of the tank, the partial-flush float correspondingly rising the first end of the partial-flush control lever being lifted, through the rigid connecting member attached to the partial-flush float, so as to move the lever about its pivot axis, causing the lever extension to move until in pressured contact against the side of the partial-flush control plate of the partial flush control arm, thereby terminating the partial flush cycle by the dual flush mechanism.

5. A dual flush mechanism, to provide a full-flush and a partial-flush capability for toilets with a tank, in combination with a single flush valve, which dual flush mechanism comprises:

a. a flush valve actuating arm, having a first end and a second end, attached near or at its second end to the flush valve by means of a flexible connecting member;

b. a first handle control means, to which the first end of the flush valve actuating arm is attached;

c. wherein the combination of first handle control means, flush valve actuating arm, flexible connecting member, and flush valve comprise the full flush capability;

d. a partial-flush control arm, having a first end and a second end, the partial-flush control arm being constructed to be capable of engaging and lifting the flush valve actuating arm;

e. A second handle control means, to which the first end of the partial flush control arm is attached;

f. means for limiting the movement of the partial-flush control arm due to operation of the second handle control means, thereby also limiting the resulting upwards rotational movement of the second end of the flush valve actuating arm due to the movement of the partial-flush control arm;

g. a partial-flush control plate, forming a portion of said partial-flush control arm;

h. a partial-flush control lever, having a first end and a second end, pivotally supported at a pivot axis; and i. a partial-flush float, attached by a rigid connection to said first end of said partial-flush control lever;

j. wherein movement of the second handle control means will pivot the partial-flush control arm, to the extent permitted by the movement limiting means, thereby lifting the second end of the flush valve actuating arm a limited distance, and, through the flexible connecting member, lifting the flush valve a limited distance to permit egress of water from the tank; subsequent release of the second handle control means permitting the partial-flush control arm to rotate downwards until the lower edge of the control plate rests against the second end of the partial-flush control lever, thereby also limiting the downward movement of the flush valve actuating lever and keeping the flush valve in a partially open position with associated continuing water egress; said water egress lowering the position of the partial-flush float, thereby pulling the first end of the partial-flush control lever downwards and rotating the partial-flush control lever about its pivot axis thereby causing the second end of the partial-flush control lever to retract out from beneath the partial-flush control plate, said retraction freeing restraint on the partial-flush control arm, allowing further downward movement of the partial-flush control arm, with a corresponding downward movement of the flush valve actuating arm and the reseating of the flush valve so as to terminate the egress of water from the tank; with refilling water raising the water level of the tank, the partial-flush float correspondingly rising, the first end of the partial-flush control lever being lifted, through the rigid connecting member attached to the partial-flush float, so as to move the partial-flush control lever about its pivot axis, causing the second end of the partial-flush control lever to move until in pressured contact against the side of the partial-flush control plate of the partial flush control arm, thereby terminating the partial flush cycle.

* * * * *